US009144968B2

(12) United States Patent
Mizutani

(10) Patent No.: US 9,144,968 B2
(45) Date of Patent: Sep. 29, 2015

(54) INKJET RECORDING APPARATUS AND INKJET RECORDING METHOD

(71) Applicant: CANON KABUSHIKI KAISHA, Tokyo (JP)

(72) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/171,540

(22) Filed: Feb. 3, 2014

(65) Prior Publication Data

US 2014/0218429 A1 Aug. 7, 2014

(30) Foreign Application Priority Data

Feb. 7, 2013 (JP) ..... 2013-022299

(51) Int. Cl.
*B41J 29/38* (2006.01)
*B41J 2/07* (2006.01)
*B41J 2/14* (2006.01)

(52) U.S. Cl.
CPC . *B41J 2/07* (2013.01); *B41J 2/1404* (2013.01)

(58) Field of Classification Search
None
See application file for complete search history.

(56) References Cited

U.S. PATENT DOCUMENTS

2010/0245437 A1* 9/2010 Nakamura ..... 347/14
2011/0193904 A1* 8/2011 Takei ..... 347/14

FOREIGN PATENT DOCUMENTS

JP 3343875 B2 11/2002

* cited by examiner

*Primary Examiner* — Geoffrey Mruk
*Assistant Examiner* — Bradley Thies
(74) *Attorney, Agent, or Firm* — Canon USA, Inc. IP Division

(57) ABSTRACT

An inkjet recording apparatus includes an inkjet recording head including a first nozzle having a discharge port, a pressure chamber having therein an element, and a flow path, a second nozzle having a flow resistance lower than that of the first nozzle, and a supply port configured to, after discharge of an ink droplet from at least one of the first nozzle and the second nozzle, supply ink to the nozzle, a storage unit storing a rank value depending on a size of a portion relating to the flow resistance, a reading unit configured to read the rank value, a determination unit configured to determine a number of discharges per unit time of each nozzle based on the rank value read by the reading unit, and a control unit configured to control each nozzle to discharge the ink droplet based on the number of discharges determined by the determination unit.

13 Claims, 15 Drawing Sheets

FIG. 6

| REFILL RANK | NOZZLE TYPE | RANGE OF REFILL FREQUENCY | CAN NOZZLE DISCHARGE AT MAXIMUM DISCHARGE FREQUENCY (24 kHz)? |
|---|---|---|---|
| HIGH RANK | 30a NOZZLE | 28～43kHz | ○ |
| | 30b NOZZLE | 43～48kHz | × |
| LOW RANK | 30a NOZZLE | 23～28kHz | × |
| | 30b NOZZLE | 28～43kHz | ○ |

FIG. 7

| REFILL RANK | NUMBER OF DISCHARGES | MASK TO BE USED |
|---|---|---|
| HIGH RANK | 30a NOZZLE > 30b NOZZLE | A MASK |
| LOW RANK | 30a NOZZLE < 30b NOZZLE | B MASK |

INKJET RECORDING APPARATUS AND INKJET RECORDING METHOD

BACKGROUND OF THE INVENTION

1. Field of the Invention

The present invention relates to an inkjet recording apparatus having an inkjet recording head for discharging ink droplets, and an inkjet recording method using the inkjet recording head.

2. Description of the Related Art

Inkjet recording apparatuses having an inkjet recording head have been known as recording apparatuses capable of outputting high-quality characters and images at low cost. The inkjet recording head discussed in Japanese Patent No. 3343875 is provided with nozzles for discharging ink droplets. As a method for manufacturing the nozzle, a method of laminating a resin layer on a silicon substrate has been known.

FIG. 14 is a plan view illustrating nozzles provided in a known inkjet recording head. FIG. 15 is a cross-sectional view taken along the section line C-C illustrated in FIG. 14.

In a known inkjet recording head 101, a silicon substrate 100 and a resin layer 200 laminated on the silicon substrate 100 form a nozzle 300 (see FIG. 15). In the nozzle 300, ink filled in a pressure chamber 320 is heated by heat generated by an electrothermal converter 330. This causes film boiling and generates bubbles, and ink droplets of a predetermined amount are discharged from a discharge port 340. Then, the ink is refilled in the pressure chamber 320 from a supply port 110 passing through the silicon substrate 100 via a flow path 310.

In the inkjet recording head 101, a refill time (the time necessary for ink refilling) depends on the structure of the flow path 310. A flow path with a small sectional area requires longer refill time since the flow resistance in the flow path 310 is large. In such a case, a refill frequency (the number of times of the refill repeated in one nozzle per unit time) decreases. Consequently, a discharge frequency (the number of times of the discharge of ink droplets in one discharge port per unit time) also decreases. Therefore, high-speed recording is disturbed. On the other hand, if the refill time is too short (the flow resistance of the flow path 310 is very small), meniscus of the ink may overshoot and the ink may overflow from the discharge port 340. Consequently, to achieve stable high-speed recording, it is desirable to define an upper limit value and a lower limit value of the refill frequency and control the refill frequency to be within the range.

In manufacturing the inkjet recording head 101 using the method discussed in Japanese Patent No. 3343875, the size (for example, a height H of the flow path 310) of a part relating to the flow resistance may vary between production lots. Since the flow resistance affects the refill frequency, the refill frequency may vary too. If the range of variance in the refill frequency is within an allowable range in which a stable high-speed recording can be performed, there are no problems in particular.

Meanwhile, in recent years, demands for further increase in recording speed in the inkjet recording apparatuses have been growing. To respond to the demands, if the above-described discharge frequency is set to be high, the lower limit value of the refill frequency necessarily becomes high. In such a case, the allowable range of the refill frequency in which a stable high-speed recording can be performed becomes narrow. Consequently, the range of variance in the refill frequency exceeds the allowable range, and the possibility of occurrence of discharge failure may increase.

SUMMARY OF THE INVENTION

The present disclosure is directed to an inkjet recording apparatus and an inkjet recording method capable of achieving a stable high-speed recording irrespective of nozzle manufacturing variations.

According to an aspect of the present disclosure, an inkjet recording apparatus includes an inkjet recording head including a first nozzle having a discharge port configured to discharge liquid, a pressure chamber having therein an element configured to generate energy to be used to discharge the liquid, and a flow path communicating with the pressure chamber, a second nozzle that is adjacent to the first nozzle having a flow resistance lower than that of the first nozzle, and a supply port configured to, after discharge of an ink droplet from at least one of the first nozzle and the second nozzle, supply ink to the nozzle that has discharged the ink droplet, a storage unit storing a rank value of the inkjet recording head ranked in advance depending on a size of a portion relating to the flow resistance, a reading unit configured to read the rank value from the storage unit, a determination unit configured to determine a number of discharges per unit time of each nozzle based on the rank value read by the reading unit, and a control unit configured to control each nozzle to discharge the ink droplet based on the number of discharges determined by the determination unit.

According to another aspect disclosed herein, an inkjet recording method includes providing an inkjet recording head including a first nozzle having a discharge port configured to discharge liquid, a pressure chamber having therein an element configured to generate energy to be used to discharge the liquid, and a flow path communicating with the pressure chamber, a second nozzle that is adjacent to the first nozzle having a flow resistance lower than that of the first nozzle, a supply port configured to, after discharge of an ink droplet from at least one of the first nozzle and the second nozzle, supply ink to the nozzle that has discharged the ink droplet, and a storage unit storing a rank value of the inkjet recording head ranked in advance depending on a size of a portion relating to the flow resistance, reading the rank value from the storage unit, determining a number of discharges per unit time of each nozzle based on the read rank value, and controlling each nozzle to discharge the ink droplet based on the determined number of discharges.

Further features of the present invention will become apparent from the following description of exemplary embodiments with reference to the attached drawings.

BRIEF DESCRIPTION OF THE DRAWINGS

FIG. 6 is a table illustrating a relationship between a refill rank and a range of refill frequencies of each nozzle.

FIG. 7 is a table illustrating a relationship between a refill rank and the number of discharges of each nozzle.

DESCRIPTION OF THE EMBODIMENTS

Figure 1:
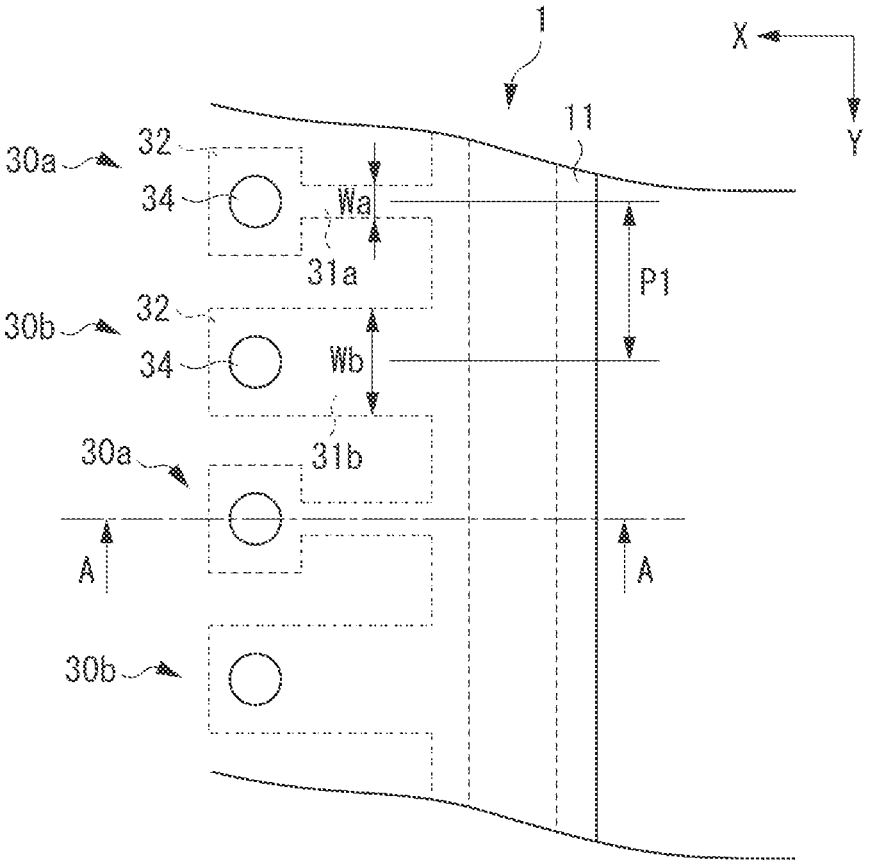
FIG. 1 is a plan view illustrating a part of a structure of an inkjet recording head provided in an inkjet recording apparatus according to a first exemplary embodiment.
Figure 2:
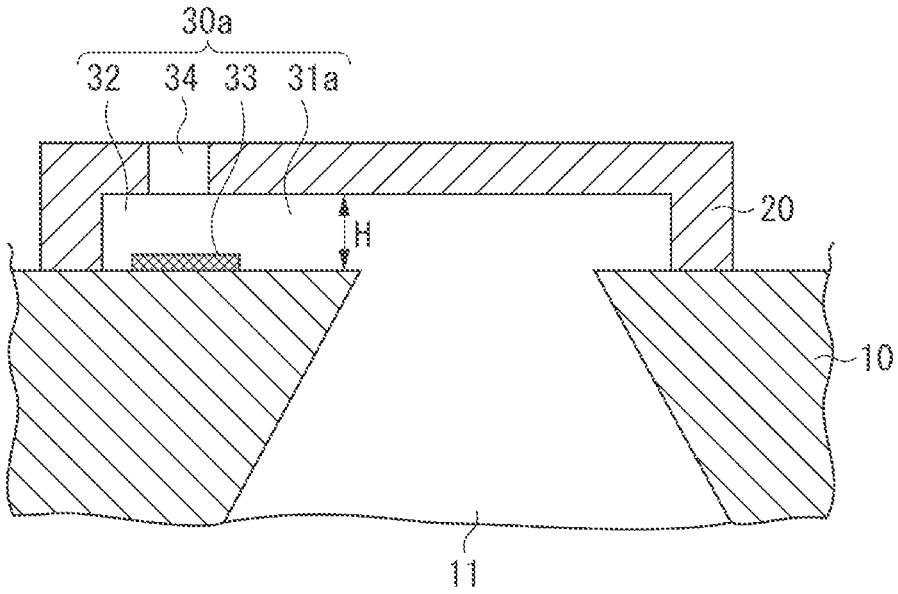
FIG. 2 is a cross-sectional view taken along the section line A-A illustrated in FIG. 1.

An inkjet recording apparatus (liquid discharge apparatus) according to a first exemplary embodiment of the present invention is described. The inkjet recording apparatus according to the exemplary embodiment has an inkjet recording head (liquid discharge head) for discharging liquid such as ink. FIG. 1 is a plan view illustrating a part of a structure of the inkjet recording head provided in the inkjet recording apparatus according to the first exemplary embodiment. FIG. 2 is a cross-sectional view taken along the section line A-A illustrated in FIG. 1. An inkjet recording head 1 according to the exemplary embodiment is mounted on a carriage (not illustrated), and the inkjet recording head 1 is configured to be movable in the scanning direction x (see FIG. 1). Hereinafter, the structure of the inkjet recording head 1 according to the exemplary embodiment is described.

The inkjet recording head 1 according to the exemplary embodiment includes a substrate 10, and a resin layer 20 laminated on the substrate 10 (see FIG. 2). The substrate 10 and the resin layer 20 form a plurality of nozzles 30*a* (first nozzles) and a plurality of nozzles 30*b* (second nozzles). Each of the nozzles 30*a* includes a flow path 31*a*, a pressure chamber 32 having therein an electrothermal conversion element 33 (element for generating energy to be used to discharge liquid), and a discharge port 34. Each of the nozzles 31*b* includes a flow path 31*b*, the pressure chamber 32 having therein the electrothermal conversion element 33, and the discharge port 34.

To the substrate 10, a supply port 11 that is a through hole is formed. From the supply port 11, liquid is supplied to the flow paths 31*a* and 31*b*. In the exemplary embodiment, black pigment ink is used. The ink supplied into the supply port 11 passes through the plurality of flow paths 31*a* and 31*b* branching off from the supply port 11. The ink that has passed through the flow paths 31*a* and 31*b* is filled in the pressure chambers 32 provided at one ends of the flow paths 31*a* and 31*b*. In each pressure chamber, the electrothermal conversion element 33 is provided. The electrothermal conversion element 33 rapidly generates heat by input of a voltage pulse. Due to the generated heat, the ink filled in the pressure chamber 32 is heated. As a result, ink droplets of a predetermined amount formed by generation of bubbles through film boiling are discharged from each of the discharge port 34. The discharge port 34 passes through the resin layer 20 at a position opposite to the electrothermal conversion element 33.

The material of the substrate 10 is not limited to silicon. Alternatively, materials capable of serving as a supporting member of the resin layer 20 can be used. For example, the material can be glass, ceramic, plastic, or metal.

In the exemplary embodiment, a total of 512 of the flow paths 31*a* and 31*b* extending to one side of the supply port 11 is arranged at a pitch P1 (see FIG. 1) of 0.0254/600 m (1/600 inch). The flow paths 31*a* and 31*b* are alternately arranged in the sub-scanning direction y orthogonal to the scanning direction x. In other words, the 512 discharge ports 34 are arranged in the sub-scanning direction y. Consequently, when the inkjet recording head 1 is scanning in the scanning direction x, if all of the discharge ports 34 simultaneously discharge ink droplets, 512 dots are recorded on a recording medium in the sub-scanning direction y.

In the nozzles 30*a* and 30*b* in the exemplary embodiment, to set the volume of the ink droplet to 12 pl, the diameter of the discharge port 34 is unified to 18.4 μm, and also, the size of the pressure chamber 34 is unified. The flow paths 31*a* and 31*b* have the same height, but have different widths. In the exemplary embodiment, a width Wa of the flow path 31*a* is narrower than a width Wb of the flow path 31*b* (see FIG. 1). In the exemplary embodiment, the width Wa is 16 μm, and the width Wb is 24 μm. For example, if both of the flow paths 31*a* and 31*b* have a height H of 18 μm, the sectional area of the flow path 31*a* is 288 $\mu m^2$, and the sectional area of the flow path 31*b* is 432 $\mu m^2$. A large sectional area of the flow path reduces flow resistance, and this shortens a refill time. In the exemplary embodiment, the flow resistance of the nozzle 30*b* is smaller than that of the nozzle 30*a*. Consequently, the refill time of the nozzle 30*b* is shorter than that of the nozzle 30*a*.

In the exemplary embodiment, the inkjet recording head 1 employs a recording method of single-pass method (a recording method for recording record data of one line in one scanning operation), and the maximum discharge frequency is 24 kHz. Further, an allowable range of the refill frequency at a movement speed of 1.016 m/s (40 inches/s) of the inkjet recording head 1 has been set to 28 to 43 kHz. To the maximum discharge frequency of 24 kHz, a lower limit value of the allowable frequency of 28 kHz and a margin of 4 kHz have been set. The increase in temperature of each nozzle due to continuous discharge of ink droplets increases the volume of the ink droplets. Then, since a flow rate of the ink necessary for refilling increases, the refill frequency decreases as compared to that at room temperatures. Consequently, the lower limit value of the allowable frequency is defined on the assumption of the decrease in the refill frequency due to the increase in temperature of the nozzles. Meanwhile, the upper limit value of the allowable frequency is set to 43 kHz. The increase in temperature of each nozzle reduces the viscosity of the ink. Consequently, the meniscus tends to overshoot in the refill of the ink. The overshot ink overflows around the discharge port 34. Consequently, the upper limit value of the allowable range is defined on the assumption of the decrease in the viscosity of ink due to the increase in temperature of the nozzles.

Figure 3:
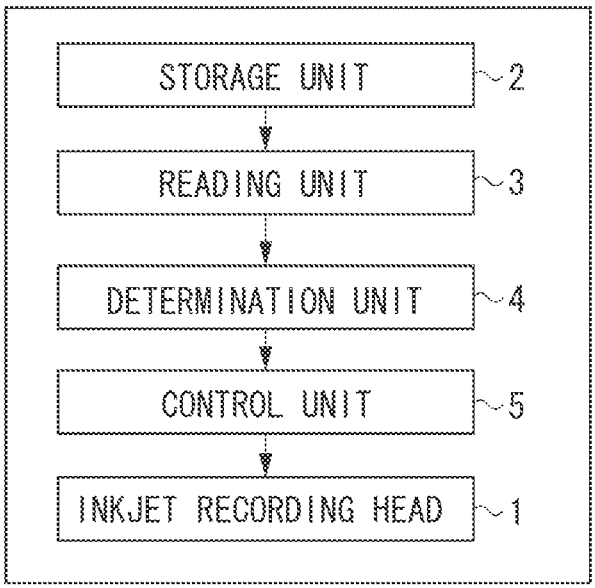
FIG. 3 is a block diagram illustrating a part of an electrical structure of the inkjet recording apparatus according to the exemplary embodiment.

FIG. 3 is a block diagram illustrating a part of an electrical structure of the inkjet recording apparatus according to the exemplary embodiment. As illustrated in FIG. 3, the inkjet recording apparatus according to the exemplary embodiment includes, in addition to the inkjet recording head 1, a storage unit 2, a reading unit 3, a determination unit 4, and a control unit 5.

The storage unit 2 is configured with, for example, an electrically erasable and programmable read-only memory (EEPROM), and stores a refill rank. The refill rank is a rank value ranking the inkjet recording head 1 in advance based on the size of a portion relating to the flow resistance of the nozzles 30*a* and 30*b*. One rank value is set to one inkjet recording head 1. The refill rank is written in the storage unit 2 at shipment.

In the exemplary embodiment, the refill rank is set based on the height H (see FIG. 2) of the flow paths 31*a* and 31*b*. The height H closely relates to refill characteristics. When the height H is high, the refill time decreases, and consequently, the refill frequency increases. On the other hand, when the height H is low, the refill time increases, and consequently, the refill frequency decreases.

The reading unit 3 reads the refill rank read from the storage unit 2. The determination unit 4 determines the number of discharges of ink droplets per unit time for each of the nozzles 30*a* and 30*b* based on the refill rank read by the reading unit 3. The control unit 5 controls the nozzles 30*a* and 30*b* to discharge ink droplets according to determined items by the determination unit 4.

In the exemplary embodiment, the height H of each flow path is set to 18 μm as a standard value, and a size tolerance is set to ±2 μm. In other words, the height H of each flow path has a range of variance of 4 μm between the production lots. A range of variance in the refill frequency corresponding to the range of variance is about 20 kHz. Therefore, the range of variance in the refill frequency is larger than the above-described refill frequency allowable range (43 kHz−28 kHz=15 kHz).

Figure 4:
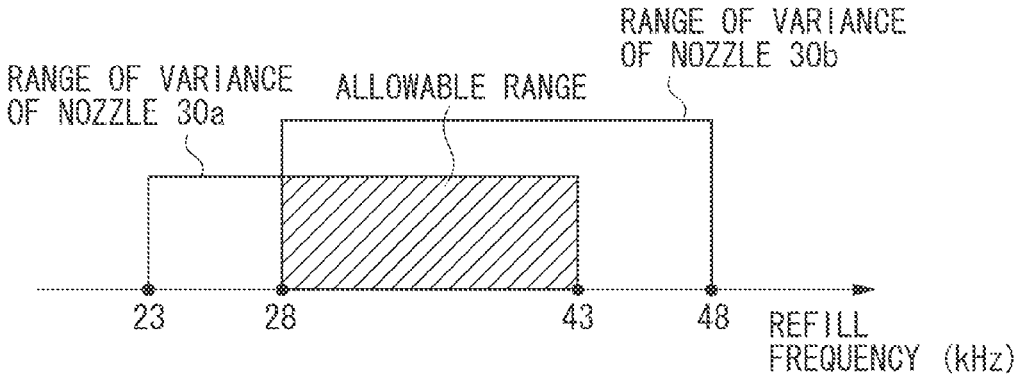
FIG. 4 illustrates a relationship between a range of variance in refill frequency of each nozzle and an allowable range of refill frequency on a number line in the exemplary embodiment.

FIG. 4 illustrates a relationship between a range of variance in refill frequency of each nozzle and a refill frequency allowable range on a number line in the exemplary embodiment. As illustrated in FIG. 4, in the exemplary embodiment, the range of variance in refill frequency of the nozzle 30*a* is 23 to 43 kHz. The range of variance in refill frequency of the nozzle 30*b* is 28 to 48 kHz. In the exemplary embodiment, the width Wa of the flow path 31*a* of the nozzle 30*a* is designed to have a refill frequency upper limit value of 43 kHz. The width Wb of the flow path 31*b* of the nozzle 30*b* is designed to have a refill frequency lower limit value of 28 kHz.

Figure 5:
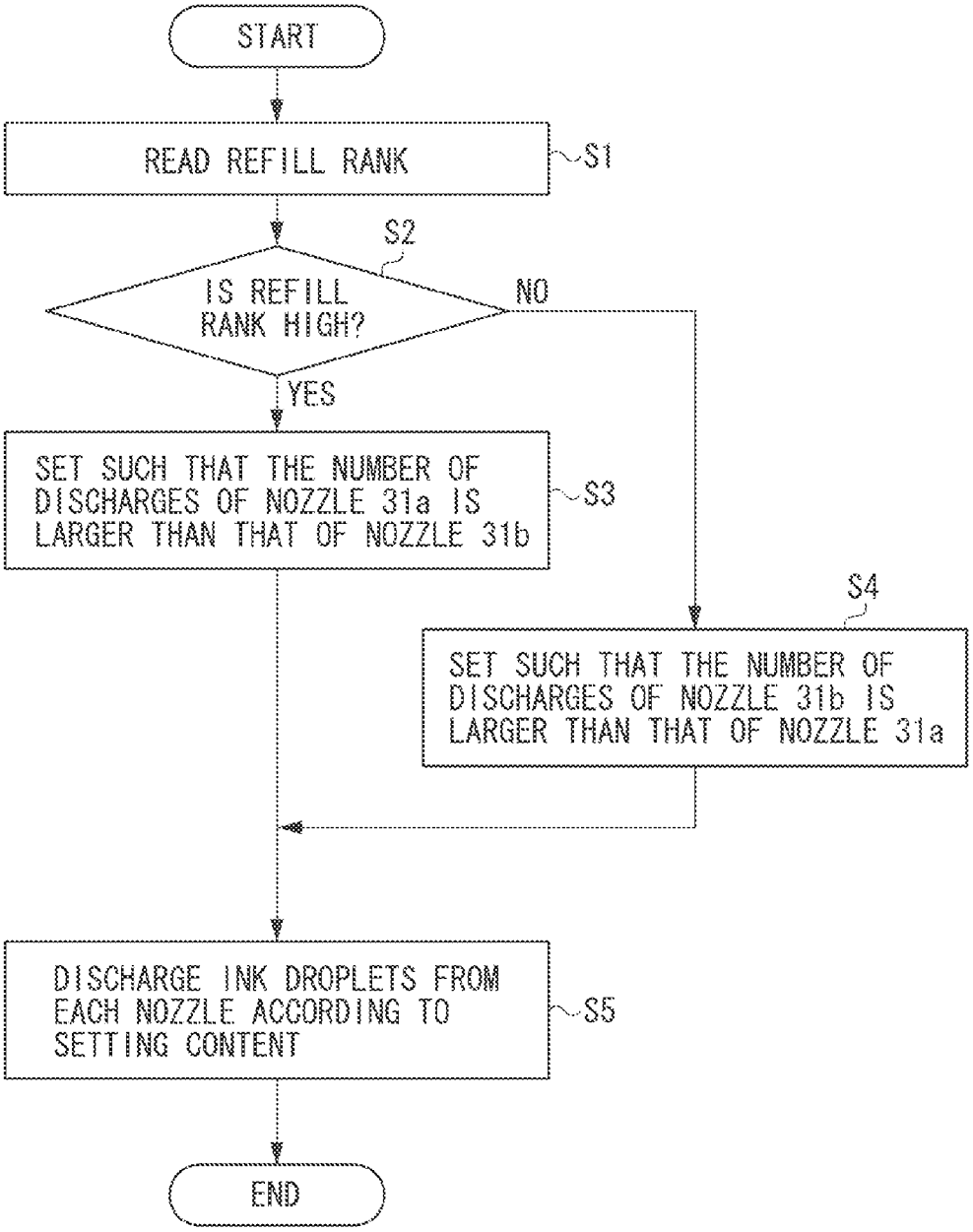
FIG. 5 is a flowchart illustrating a procedure of recording operation of the inkjet recording apparatus according to the exemplary embodiment.

FIG. 5 is a flowchart illustrating a procedure of recording operation of the inkjet recording apparatus according to the exemplary embodiment.

In step S1, the reading unit 3 reads a refill rank from the storage unit 2.

In step S2, the determination unit 4 determines whether the refill rank read by the reading unit 3 is a high rank or a low rank. In the exemplary embodiment, when the height H of the flow path exceeds the above-described standard value (18 μm), the refill rank is ranked high. When the height H of the flow path falls below the standard value, the refill rank is ranked low.

FIG. 6 is a table illustrating a relationship between a refill rank and a range of refill frequencies of each nozzle.

When the refill rank is high, the height of the flow paths 31*a* and 31*b* is formed to be higher than the standard value. Consequently, the refill frequencies of the nozzles 30*a* and 30*b* are distributed in a high range in the range of variance illustrated in FIG. 4. In such a case, as illustrated in FIG. 6, it is highly possible that the refill frequency of the nozzle 30*a* becomes the range of 28 to 43 kHz that is within the allowable range. Thus, the nozzle 30*a* can perform discharge at the maximum discharge frequency (24 kHz). Meanwhile, it is highly possible that the refill frequency of the nozzle 30*b* becomes the range of 43 to 48 kHz that is out of the allowable range.

When the refill rank is low, the height of the flow paths 31*a* and 31*b* is formed to be lower than the standard value. Consequently, the refill frequencies of the nozzles 30*a* and 30*b* are distributed in a low range in the range of variance illustrated in FIG. 4. In such a case, as illustrated in FIG. 6, it is highly possible that the refill frequency of the nozzle 30*a* becomes the range of 23 to 28 kHz that is out of the allowable range. Meanwhile, it is highly possible that the refill frequency of the nozzle 30*b* becomes the range of 28 to 43 kHz that is within the allowable range. Thus, the nozzle 30*b* can perform discharge at the maximum discharge frequency.

FIG. 7 is a table illustrating a relationship between a refill rank and the number of discharges of each nozzle.

When the refill rank is high, as described above, it is highly possible that the refill frequency of the nozzle 30*a* is within the allowable range in which the nozzle 30*a* can stably perform discharge at the maximum discharge frequency. Therefore, in step S3, the determination unit 4 selects a mask A (see FIG. 8A) that has been set such that the number of discharges of ink droplets per unit time from one discharge port 34 of the nozzle 30*a* is larger than that of the nozzle 30*b*.

On the other hand, when the refill rank is low, as described above, it is highly possible that the refill frequency of the nozzle 30*b* is within the allowable range in which the nozzle 30*b* can stably perform discharge at the maximum discharge frequency. Therefore, in step S4, the determination unit 4 selects a mask B (see FIG. 8B) that has been set such that the above-described number of discharges of the nozzle 30*b* is larger than that of the nozzle 30*a*.

Figure 8A:
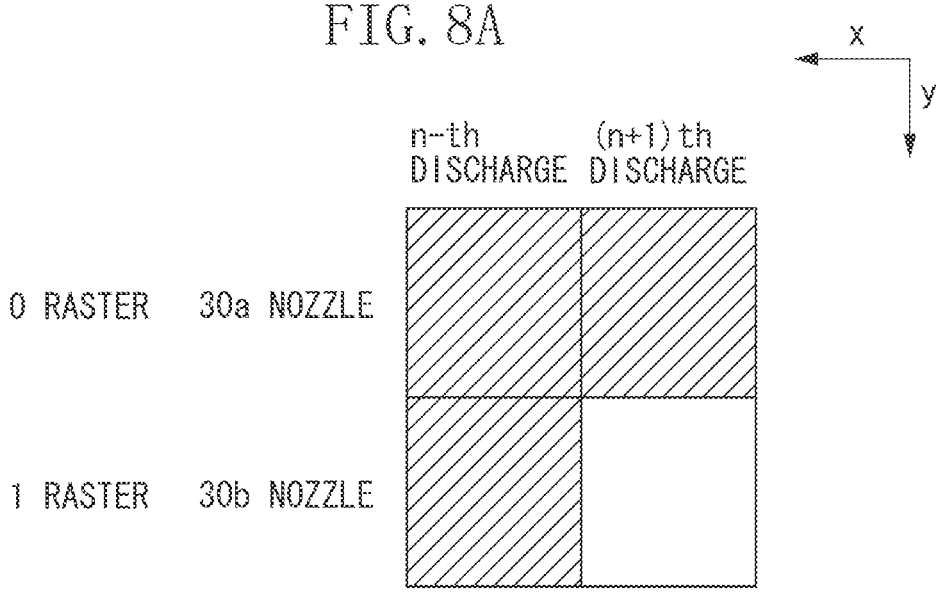
FIGS. 8A and 8B illustrate mask patterns relating to discharge control of ink droplets.
Figure 8B:
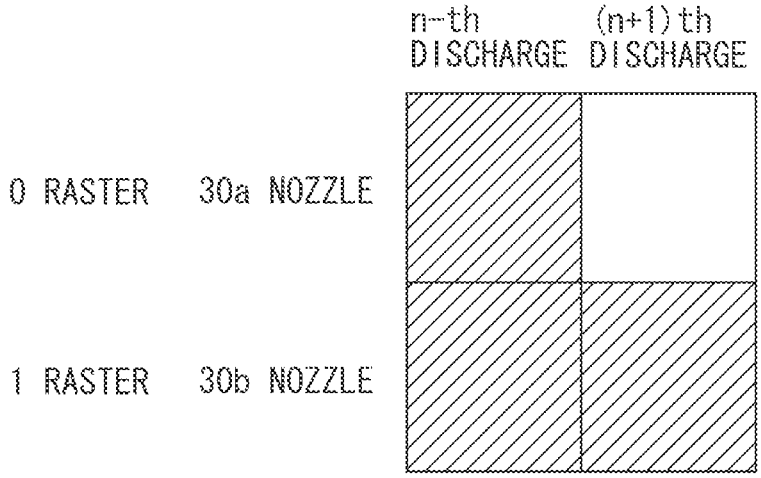

FIGS. 8A and 8B illustrate mask patterns relating to the discharge control of ink droplets. FIG. 8A illustrates a mask pattern of the above-described mask A. FIG. 8B illustrates a mask pattern of the above-described mask B.

In the exemplary embodiment, raster data (binary data) called a mask pattern is assigned to the electrothermal conversion element 33 of each nozzle. FIGS. 8A and 8B illustrate, for the sake of a simple description, patterns for discharging ink droplets toward two sequential pixels in the scanning direction x. In FIGS. 8A and 8B, the pixels with black oblique lines indicate pixels in which ink droplets are discharged (for recording dots), and the white pixels indicate pixels in which ink droplets are not discharged.

With the mask pattern of the mask A illustrated in FIG. 8A, the nozzle 30*a* is set to continuously discharge ink droplets. Meanwhile, the nozzle 30*b* is set to intermittently discharge ink droplets. With the mask pattern, the number of discharges from the nozzle 30*a* becomes larger than that from the nozzle 30*b*.

With the mask pattern of the mask B illustrated in FIG. 8B, the nozzle 30*a* is set to intermittently discharge ink droplets. Meanwhile, the nozzle 30*b* is set to continuously discharge ink droplets. With the mask pattern, the number of discharges from the nozzle 30*b* becomes larger than that from the nozzle 30*a*.

In the exemplary embodiment, when externally input image data is recorded, an AND operation is performed between binary record data indicating a discharge pattern of each nozzle corresponding to the image data and the above-described mask pattern. The control unit 5 associates the result of the AND operation and sends a voltage pulse to the electrothermal conversion element 33. In step S5, the control unit 5 controls each nozzle to discharge ink droplets.

In the inkjet recording apparatus according to the exemplary embodiment, the nozzles 30*a* and 30*b* of the different widths are alternately arranged to be adjacent to each other. Further, based on a refill rank ranked in advance depending on the height of the flow path, the determination unit 4 determines the number of discharges of each nozzle. According to the exemplary embodiment, even if the height of the flow paths varies, the refill frequency of one of the nozzle 30*a* and the nozzle 30*b* falls within the allowable range in which stable discharge can be performed at the maximum discharge frequency. Consequently, stable high-speed recording can be performed using the single-pass method.

Figure 9:
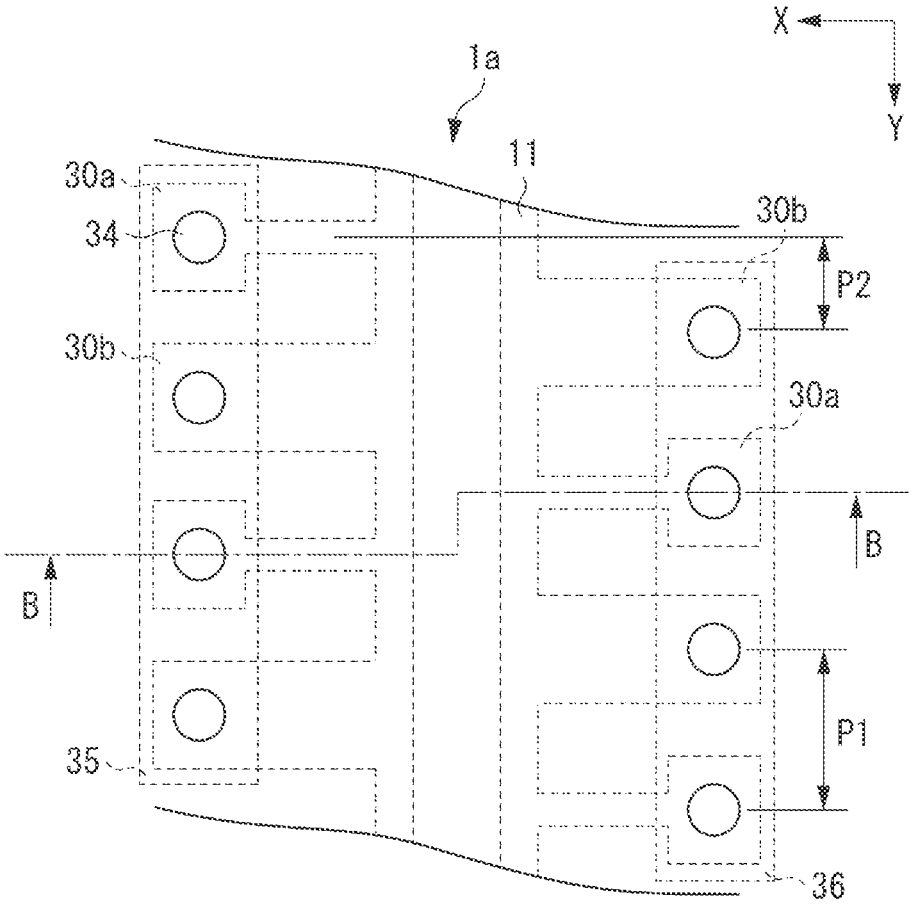
FIG. 9 is a plan view illustrating a part of a structure of an inkjet recording head provided in an inkjet recording apparatus according to a second exemplary embodiment.
Figure 10:
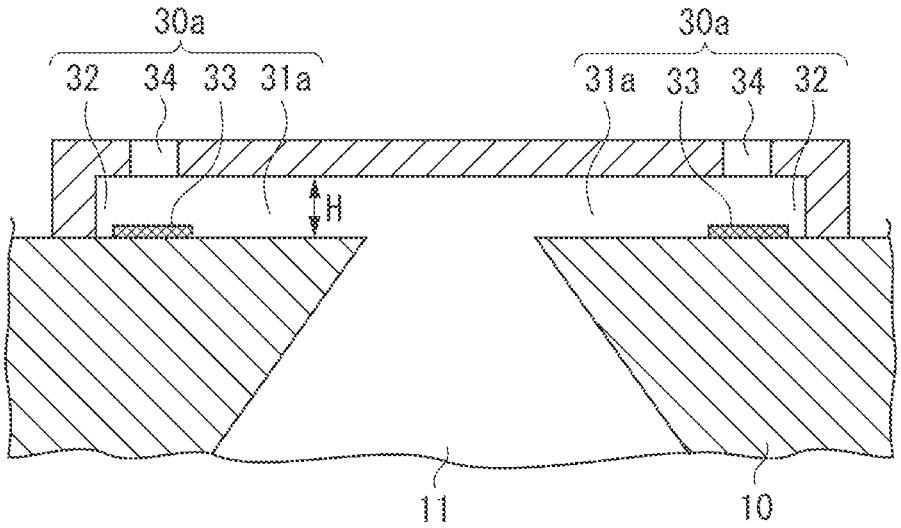
FIG. 10 is a cross-sectional view taken along the section line B-B illustrated in FIG. 9.

An inkjet recording apparatus according to a second exemplary embodiment is described. Hereinafter, points different from those in the inkjet recording apparatus according to the above-described first exemplary embodiment will be mainly described. FIG. 9 is a plan view illustrating a part of a structure of an inkjet recording head provided in the inkjet recording apparatus according to the second exemplary embodiment. FIG. 10 is a cross-sectional view taken along the section line B-B illustrated in FIG. 9. The same reference numerals are applied to components similar to those in the above-described inkjet recording head 1 according to the first exemplary embodiment, and their detailed descriptions are omitted.

In an inkjet recording head 1*a* according to the exemplary embodiment, as illustrated in FIG. 9, at a supply port 11, two nozzle arrays 35 and 36 are arranged on both sides in the scanning direction x. In each nozzle array, a plurality of nozzles 30*a* and a plurality of nozzles 30*b* are alternately arranged in the sub-scanning direction y. A pitch P1 between the nozzle 30*a* and the nozzle 30*b* is, similarly to the first exemplary embodiment, 0.0254/600 m (1/600 inch). The nozzle array 35 and the nozzle array 36 are arranged to shift by a pitch P2 in the sub-scanning direction y (the arranging direction of the discharge ports 34). In the exemplary embodiment, the pitch P2 is 0.0254/1200 m (1/1200 inch). With this arrangement in the exemplary embodiment, when ink droplets are simultaneously discharged from all discharge ports 34, 1024 dots are recorded on a recording medium. The volume of the ink droplet has been set to 12 pl similarly to the first exemplary embodiment.

The inkjet recording apparatus according to the exemplary embodiment performs recording operation according to the flowchart illustrated in FIG. 5 similarly to the first exemplary embodiment.

Figure 11A:
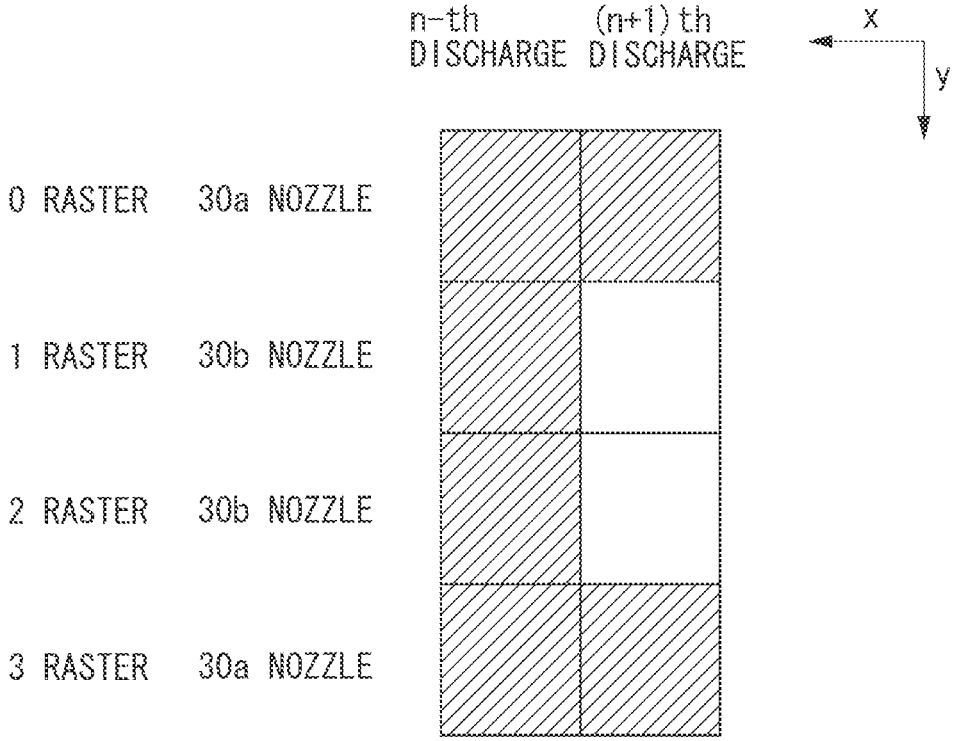
FIGS. 11A and 11B illustrate mask patterns to be used in the second exemplary embodiment.
Figure 11B:
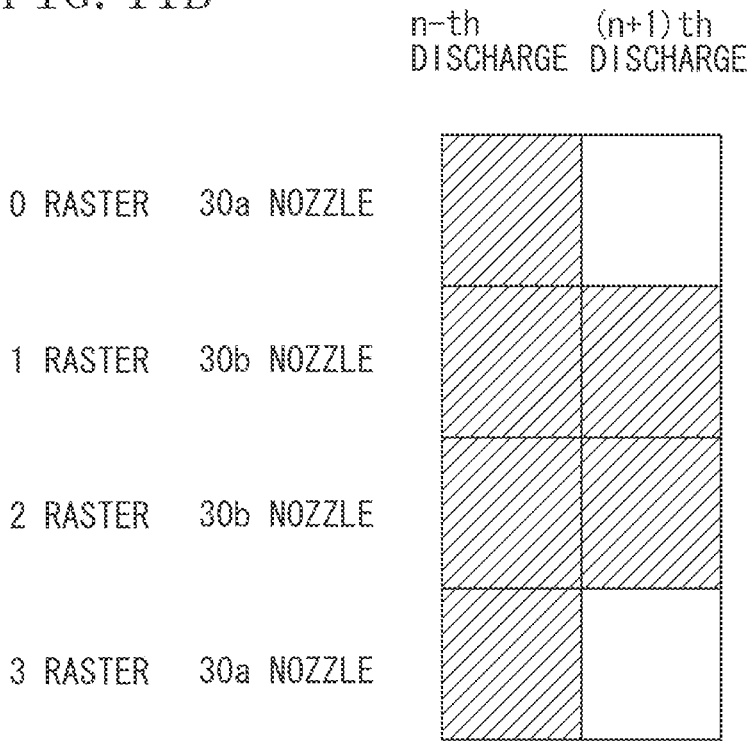

FIGS. 11A and 11B illustrate mask patterns to be used in the second exemplary embodiment. In FIGS. 11A and 11B, "raster 0" and "raster 2" indicate discharge patterns of the nozzles 30*a* and 30*b* in the nozzle array 35, respectively. "Raster 1" and "raster 3" indicate discharge patterns of the nozzles 30*a* and 30*b* in the nozzle array 36, respectively.

When the refill rank read by the reading unit 3 is high, the determination unit 4 selects the mask C of the mask pattern illustrated in FIG. 11A. In the mask pattern illustrated in FIG. 11A, the nozzle 30*a* in each nozzle array is set to continuously discharge ink droplets. Meanwhile, the nozzle 30*b* in each nozzle array is set to intermittently discharge ink droplets. With the mask pattern, the number of discharges in the nozzle 30*a* becomes larger than that in the nozzle 30*b*.

When the refill rank read by the reading unit 3 is low, the determination unit 4 selects the mask D of the mask pattern illustrated in FIG. 11B. In the mask pattern illustrated in FIG. 11B, the nozzle 30*a* in each nozzle array is set to intermittently discharge ink droplets. Meanwhile, the nozzle 30*b* in each nozzle array is set to continuously discharge ink droplets. With the mask pattern, the number of discharges in the nozzle 30*b* becomes larger than that in the nozzle 30*a*.

According to the exemplary embodiment, similarly to the first exemplary embodiment, even if the height of the flow paths varies, the refill frequency of one of the nozzle 30*a* and the nozzle 30*b* falls within the allowable range in which stable discharge can be performed at the maximum discharge frequency. Consequently, stable high-speed recording can be performed using the single-pass method.

Further, in the exemplary embodiment, the number of dots (the number of ink droplets) per unit area on a recording medium is twice that in the first exemplary embodiment. Consequently, resolution is improved and high-quality recording can be achieved.

Figure 12:
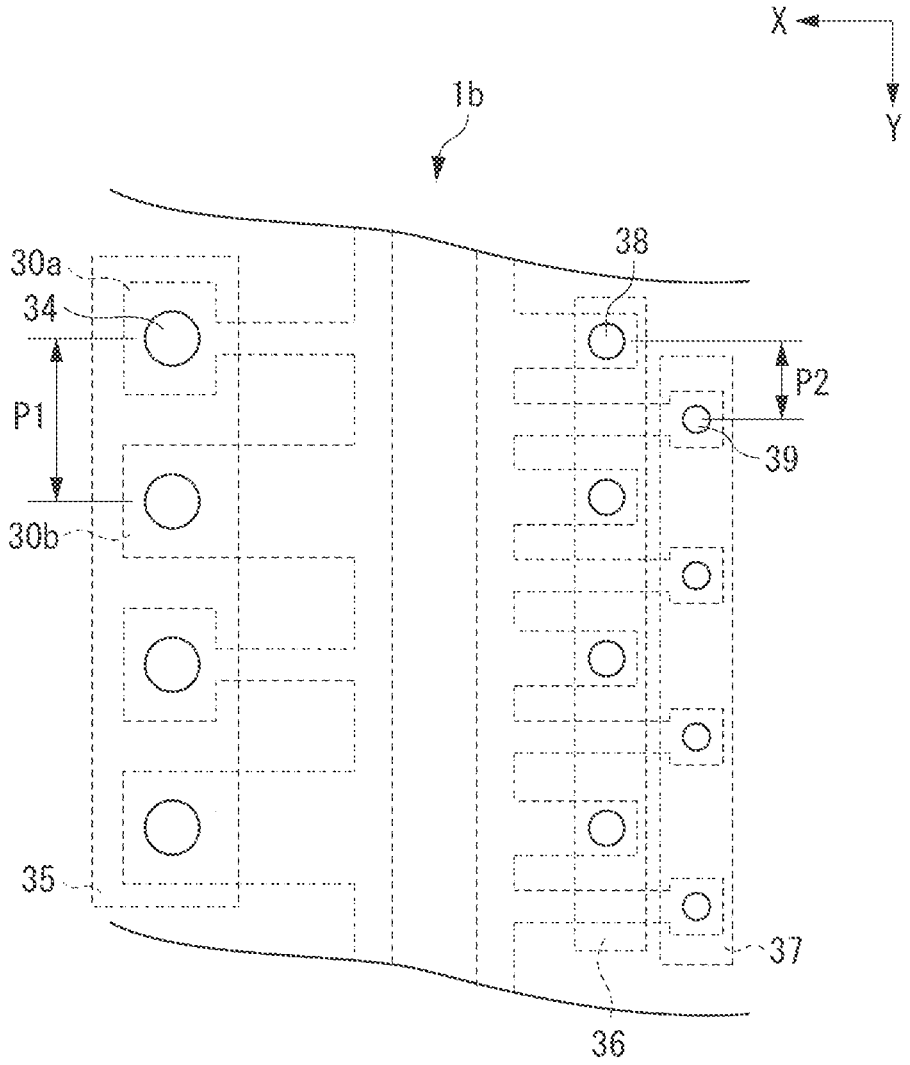
FIG. 12 is a plan view illustrating a part of a structure of an inkjet recording head provided in an inkjet recording apparatus according to the third exemplary embodiment.

An inkjet recording apparatus according to a third exemplary embodiment of the present disclosure is described. Hereinafter, points different from those in the above-described inkjet recording apparatuses according to the first and second exemplary embodiments will be mainly described. FIG. 12 is a plan view illustrating a part of a structure of an inkjet recording head provided in the inkjet recording apparatus according to the third exemplary embodiment.

In an inkjet recording head 1*b* according to the exemplary embodiment, as illustrated in FIG. 12, a nozzle array 35 is arranged to one side of a supply port 11, and nozzle arrays 36 and 37 are arranged to the other side of the supply port 11. In the nozzle array 35, similarly to the first exemplary embodiment, a plurality of nozzles 30*a* and a plurality of nozzles 30*b* are alternately arranged in the sub-scanning direction y with a pitch P1. In the nozzle array 36, nozzles having a discharge port 38 of which diameter is smaller than that of the discharge port 34 of the nozzles 30*a* and 30*b* are arranged with the same pitch as in the nozzle array 35. In the nozzle array 37, nozzles having a discharge port 39 of which the diameter is smaller than that of the discharge port 38 are arranged with the same pitch as in the nozzle array 36. Between the discharge port 38 and the discharge port 39, a pitch P2 of half size of the above-described pitch P1 is provided. The discharge port 39 is arranged at a position far from the discharge port 11 as compared to the discharge port 38.

In the exemplary embodiment, an ink droplet of 5 pl is discharged from the discharge port 34, an ink droplet of 2 pl is discharged from the discharge port 38, and an ink droplet of 1 pl is discharged from the discharge port 39. In the exemplary embodiment, color ink is used.

With the inkjet recording head 1*b* according to the exemplary embodiment having the above-described structure, when recording an image of normal image quality, ink droplets of the color ink is discharged only from the discharge ports 34 by performing discharging control similar to that in the first exemplary embodiment. The discharge ports 38 and 39 are used to record a high-quality image, for example, photographic tone.

According to the exemplary embodiment, similarly to the first exemplary embodiment, even if the height of the flow paths varies, the refill frequency of one of the nozzle 30*a* and the nozzle 30*b* falls within the allowable range in which stable discharge can be performed at the maximum discharge frequency. Consequently, stable high-speed recording can be performed using the single-pass method. Especially, the exemplary embodiment can be applied to an inkjet recording head having functions capable of recording a high-quality image with color ink.

Figure 13:
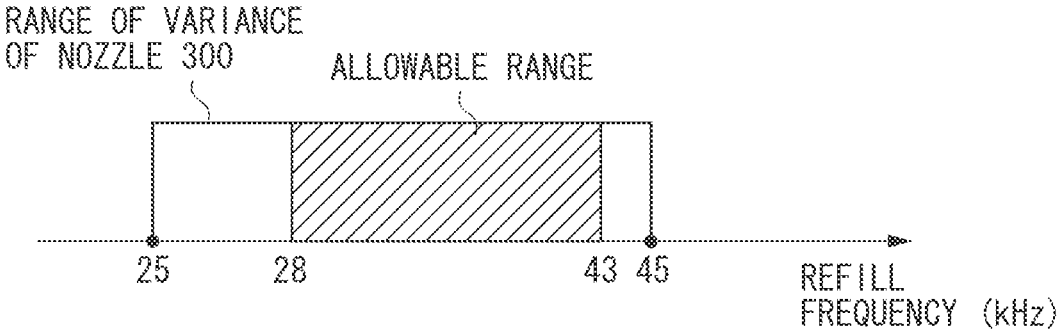
FIG. 13 illustrates a relationship between a range of variance in refill frequencies of a nozzle and an allowable range of the refill frequencies on a number line in a comparative example.
Figure 14:
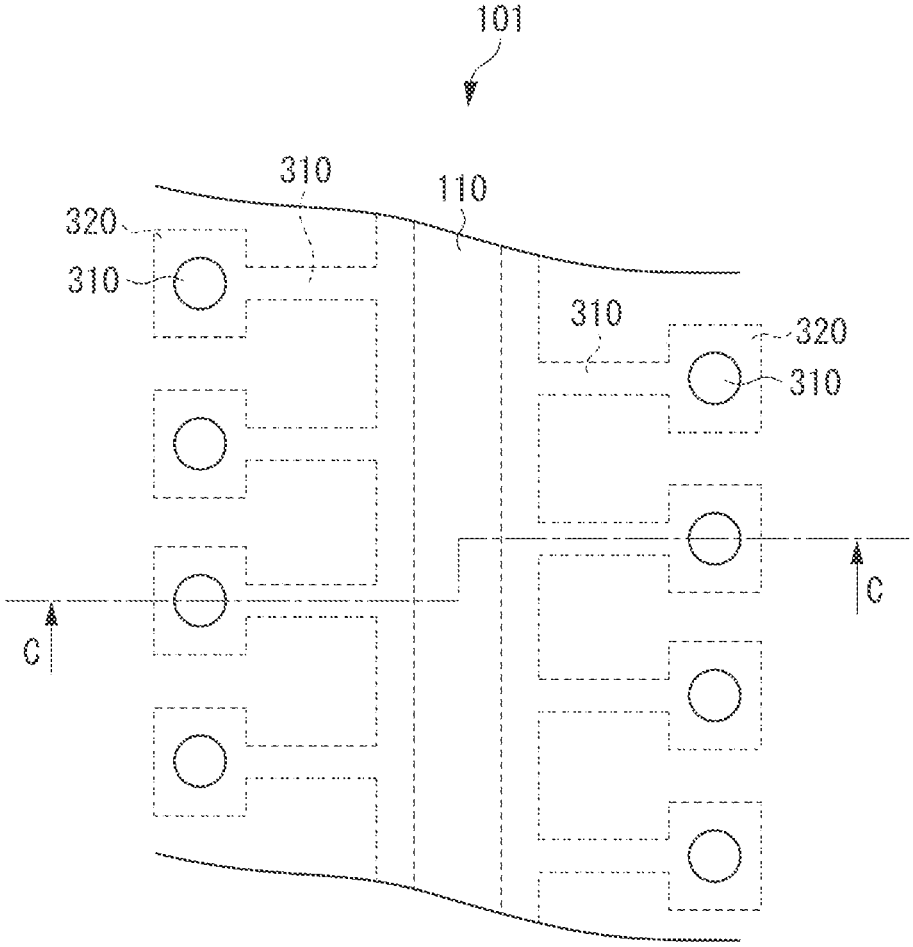
FIG. 14 is a plan view illustrating nozzles provided in a known inkjet recording head.
Figure 15:
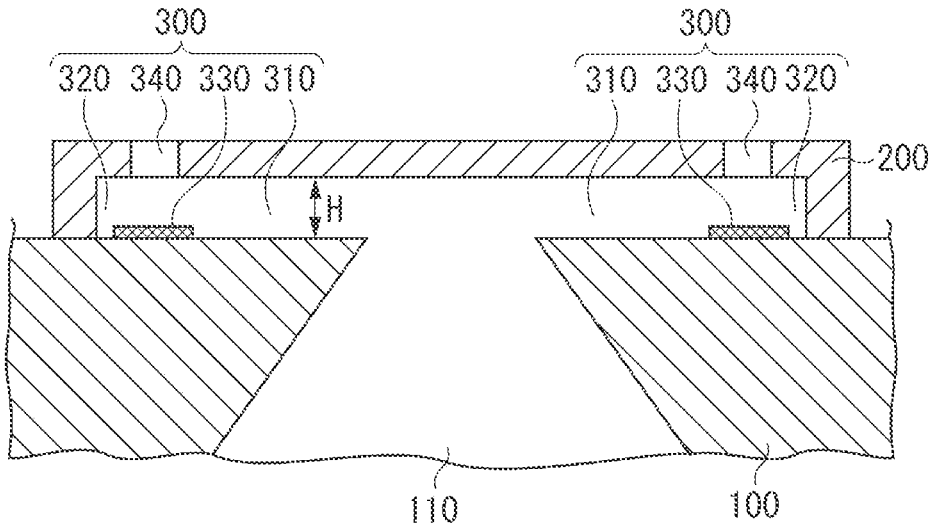
FIG. 15 is a cross-sectional view taken along the section line C-C illustrated in FIG. 14.

As an comparative example of the exemplary embodiments of the present disclosure, the known inkjet recording head 101 illustrated in FIGS. 14 and 15 is used. FIG. 13 illustrates a relationship between a range of variance in refill frequencies and an allowable range of the refill frequencies on a number line in the comparative example.

As illustrated in FIG. 14, in the known inkjet recording head 101, the width of all flow paths 310 is unified. Consequently, when the height H (see FIG. 15) of the flow path 310 is higher than the standard value, the refill frequencies of nozzles 300 are distributed in a high range within the range of variance. Then, it is highly possible that the refill frequency of the nozzle 300 becomes the range of 43 to 45 kHz that is out of the allowable range. On the other hand, when the height H of the flow path 310 is lower than the standard value, the refill frequencies of the nozzles 300 are distributed in a low range within the range of variance. Consequently, it is highly possible that the refill frequency of the nozzle 300 becomes the range of 25 to 28 kHz that is out of the allowable range.

Meanwhile, in the above-described inkjet recording heads 1, 1*a*, and 1*b* according to the exemplary embodiments of the present disclosure, the nozzles 30*a* and 30*b* each having the flow path with different width are alternately arranged to be adjacent to each other. Further, based on a refill rank ranked in advance depending on the height of the flow path, the determination unit 4 determines the number of discharges of each nozzle. According to the exemplary embodiments, even if the height of the flow paths varies, the refill frequency of one of the nozzle 30*a* and the nozzle 30*b* falls within the allowable range in which stable discharge can be performed at the maximum discharge frequency. Consequently, stable high-speed recording can be performed.

According to the exemplary embodiments of the present invention, stable high-speed recording can be achieved even in the occurrence of variations among nozzles at manufacturing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-022299 filed Feb. 7, 2013, which is hereby incorporated by reference herein in its entirety.

What is claimed is:

1. An inkjet recording apparatus comprising:

an inkjet recording head including a first nozzle having a discharge port configured to discharge liquid, a pressure chamber having therein an element configured to generate energy for discharging the liquid, and a flow path communicating with the pressure chamber, a second nozzle adjacent the first nozzle having a flow resistance less than a flow resistance of the first nozzle, and a supply port configured to, after discharge of an ink droplet from at least one of the first nozzle and the second nozzle, supply ink to the nozzle that has discharged the ink droplet;

a storage unit storing a rank value of the inkjet recording head ranked in advance depending on a size of a portion relating to the flow resistance;

a reading unit configured to read the rank value from the storage unit;

a determination unit configured to determine a number of discharges per unit time of each nozzle based on the rank value read by the reading unit; and a control unit configured to control each nozzle to discharge the ink droplet based on the number of discharges determined by the determination unit.

2. The inkjet recording apparatus according to claim 1, wherein the rank value is ranked at a high rank when the size exceeds a standard value, and the rank value is ranked at a low rank when the size is below the standard value.

3. The inkjet recording apparatus according to claim 2, wherein the determination unit sets the number of discharges such that the number of discharges in the first nozzle is greater than that in the second nozzle when the rank value is ranked at the high rank.

4. The inkjet recording apparatus according to claim 2, wherein the determination unit sets the number of discharges such that the number of discharges in the second nozzle is greater than that in the first nozzle when the rank value is ranked at the low rank.

5. The inkjet recording apparatus according to claim 1, wherein the inkjet recording head is configured to be movable in a scanning direction, and a plurality of the first nozzles and a plurality of the second nozzles are alternately arranged in a direction perpendicular to the scanning direction.

6. The inkjet recording apparatus according to claim 1, wherein each of the first nozzles and the second nozzles has the flow path in which the ink supplied from the supply port flows, the pressure chamber in which the ink supplied through the flow path is filled, an electrothermal converter as the element provided in the pressure chamber configured to generate heat according to control by the control unit, and the discharge port that is formed at a position opposite to the electrothermal converter configured to discharge the ink droplet generated by the heat generated by the electrothermal converter, and a width of the flow path in the first nozzle is narrower than that in the second nozzle.

7. The inkjet recording apparatus according to claim 6, wherein the portion is a height of the flow path.

8. An inkjet recording method comprising:

providing an inkjet recording head including a first nozzle having a discharge port configured to discharge liquid, a pressure chamber having therein an element configured to generate energy for discharging the liquid, and a flow path communicating with the pressure chamber, a second nozzle adjacent the first nozzle having a flow resistance less than a flow resistance of the first nozzle, a supply port configured to, after discharge of an ink droplet from at least one of the first nozzle and the second nozzle, supply ink to the nozzle that has discharged the ink droplet, and a storage unit storing a rank value of the inkjet recording head ranked in advance depending on a size of a portion relating to the flow resistance;

reading the rank value from the storage unit;

determining a number of discharges per unit time of each nozzle based on the read rank value; and controlling each nozzle to discharge the ink droplet based on the determined number of discharges.

9. The inkjet recording method according to claim 8, further comprising setting the rank value at a high rank when the size exceeds a standard value, and setting the rank value at a low rank when the size is below the standard value.

10. The inkjet recording method according to claim 9, further comprising setting the number of discharges such that the number of discharges in the first nozzle is greater than that in the second nozzle when the rank value is ranked at the high rank.

11. The inkjet recording method according to claim 9, further comprising setting the number of discharges such that the number of discharges in the second nozzle is greater than that in the first nozzle when the rank value is ranked at the low rank.

12. The inkjet recording method according to claim 8, wherein each of the first nozzles and the second nozzles has the flow path in which the ink supplied from the supply port flows, the pressure chamber in which the ink supplied through the flow path is filled, an electrothermal converter provided in the pressure chamber configured to generate heat according to control by the control unit, and the discharge port that is formed at a position opposite to the electrothermal converter configured to discharge the ink droplet generated by the heat generated by the electrothermal converter, and wherein the inkjet recording method further comprising forming a width of the flow path in the second nozzle to be wider than that in the first nozzle.

13. The inkjet recording method according to claim 12, further comprising setting the rank value depending on a height of the flow path.

* * * * *